US010961878B2

(12) United States Patent
Fimml et al.

(10) Patent No.: US 10,961,878 B2
(45) Date of Patent: Mar. 30, 2021

(54) VALVE TRAIN FOR THE VARIABLE ACTUATION OF AN INLET VALVE AND AN OUTLET VALVE, AND INTERNAL COMBUSTION ENGINE HAVING A VALVE TRAIN OF THIS TYPE

(71) Applicant: MTU FRIEDRICHSHAFEN GMBH, Friedrichshafen (DE)

(72) Inventors: Wolfgang Fimml, Hörbranz (AT); Jonathan Lipp, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 16/092,351

(22) PCT Filed: Mar. 23, 2017

(86) PCT No.: PCT/EP2017/000361
§ 371 (c)(1),
(2) Date: Oct. 9, 2018

(87) PCT Pub. No.: WO2017/174175
PCT Pub. Date: Oct. 12, 2017

(65) Prior Publication Data

US 2019/0120093 A1 Apr. 25, 2019

(30) Foreign Application Priority Data

Apr. 8, 2016 (DE) ..... 10 2016 205 910.6

(51) Int. Cl.
*F01L 9/14* (2021.01)
*F01L 9/11* (2021.01)
(Continued)

(52) U.S. Cl.
CPC ..... *F01L 9/14* (2021.01); *F01L 1/267* (2013.01); *F01L 1/3442* (2013.01); *F01L 9/11* (2021.01); *F01L 2001/34446* (2013.01)

(58) Field of Classification Search
CPC ..... F01L 9/025; F01L 1/3442; F01L 1/267; F01L 2001/34446; F01L 9/021;
(Continued)

(56) References Cited

U.S. PATENT DOCUMENTS 5,499,606 A * 3/1996 Robnett ..... F01L 9/025 123/90.12
5,537,976 A * 7/1996 Hu ..... F01L 9/021 123/322
(Continued)

FOREIGN PATENT DOCUMENTS

DE 10113722 A1 9/2002
DE 102015207622 A1 10/2016
(Continued)

*Primary Examiner* — Patrick Hamo
*Assistant Examiner* — Wesley G Harris
(74) *Attorney, Agent, or Firm* — Lucas & Mercanti, LLP; Klaus P. Stoffel

(57) ABSTRACT

A valve train for the variable actuation of an inlet valve and an outlet valve of a combustion chamber of an internal combustion engine, having a first operative connection between a valve actuating device and the inlet valve and a second operative connection between the valve actuating device and the outlet valve. The first operative connection and the second operative connection are assigned an interrupting element which is set up to temporarily interrupt the operative connections. The first operative connection and the second operative connection are connected to the same interrupting element in such a way that the first operative connection and the second operative connection can be interrupted temporarily by way of the interrupting element.

6 Claims, 3 Drawing Sheets

(51) Int. Cl.
*F01L 1/26* (2006.01)
*F01L 1/344* (2006.01)

(58) Field of Classification Search
CPC ..... F01L 9/02; F01L 9/10; F01L 9/14; F01L 9/11; F01L 9/12
USPC ..... 123/90.12
See application file for complete search history.

(56) References Cited

U.S. PATENT DOCUMENTS

| | | | | |
|---|---|---|---|---|
| 5,746,175 | A * | 5/1998 | Hu | F01L 9/021 123/322 |
| 6,257,183 | B1 * | 7/2001 | Vorih | F01L 13/00 123/90.12 |
| 6,886,509 | B2 | 5/2005 | Perez Cuadro | |
| 8,079,331 | B2 | 12/2011 | Vattaneo | |
| 2008/0006231 | A1 * | 1/2008 | Noss | F01L 1/267 123/90.12 |
| 2017/0081986 | A1 * | 3/2017 | Wigsten | F01L 1/26 |
| 2017/0183989 | A1 * | 6/2017 | Wigsten | F01L 9/02 |

FOREIGN PATENT DOCUMENTS

| | | | |
|---|---|---|---|
| EP | 2138680 | A1 | 12/2009 |
| GB | 2455067 | A | 6/2009 |
| JP | S6116215 | A | 1/1986 |
| JP | H07208132 | A | 8/1995 |
| WO | 2015175213 | A1 | 11/2015 |

* cited by examiner

VALVE TRAIN FOR THE VARIABLE ACTUATION OF AN INLET VALVE AND AN OUTLET VALVE, AND INTERNAL COMBUSTION ENGINE HAVING A VALVE TRAIN OF THIS TYPE

CROSS-REFERENCE TO RELATED APPLICATIONS

The present application is a 371 of International application PCT/EP2017/000361, filed Mar. 23, 2017, which claims priority of DE 10 2016 205 910.6, filed Apr. 8, 2016, the priority of these applications is hereby claimed and these applications are incorporated herein by reference.

BACKGROUND OF THE INVENTION

The invention relates to a valve train for the variable actuation of an inlet valve and an outlet valve of a combustion chamber of an internal combustion engine, and to an internal combustion engine having a valve train of this type.

In the case of a valve train of this type, a first operative connection is configured between a valve-actuating device and the inlet valve, wherein a second operative connection is configured between the valve-actuating device and the outlet valve. At least the first operative connection is assigned an interrupting element which is configured to temporarily interrupt the first operative connection. The second operative connection can also be assigned an interrupting element which is configured to temporarily interrupt the second operative connection. Valve trains of this type, which are realized by temporary interruptions to the operative connection, are known under the key word "lost-motion". A lost-motion valve train can be provided on the inlet side, or else on the inlet side and on the outlet side. In the case of known configurations in which both the first operative connection and the second operative connection can be temporarily interrupted, each of the operative connections is in each case assigned an interrupting element, thus the first operative connection is assigned a first interrupting element, and the second operative connection is assigned a second interrupting element which is different from the first interrupting element. However, this configuration is expensive and, especially for construction space reasons, is difficult to integrate into an existing internal combustion engine. In particular, the requirement for space here is very large because of the two separate interrupting elements.

SUMMARY OF THE INVENTION

The invention is based on the object of providing a valve train and an internal combustion engine having a valve train of this type, where the disadvantages mentioned do not occur.

The object is achieved in particular by a valve train for the variable actuation of an inlet valve and an outlet valve of a combustion chamber of an internal combustion engine being provided, which valve train has a first operative connection between a valve-actuating device and the inlet valve, wherein said valve train furthermore has a second operative connection between the valve-actuating device and the outlet valve. The first and the second operative connection are assigned an interrupting element which is configured to temporarily interrupt the operative connections, wherein the first operative connection and the second operative connection are connected to the same interrupting element in such a manner that the first and the second operative connection can be interrupted temporarily—in particular in an alternating manner—by the same interrupting element. Owing to the fact that the opening flanks for the inlet valve, on the one hand, and the outlet valve, on the other hand, are offset in terms of time with respect to one another, with the actuating cycles for the inlet valve, on the one hand, and the outlet valve, on the other hand, in particular being phase-displaced with respect to one another, it is possible to bring about, both for the inlet valve and also for the outlet valve, a variable actuation with only one and in particular precisely one interrupting element which can temporarily interrupt the first operative connection in particular at a first point in time within an operating cycle of the combustion chamber, wherein said interrupting element can temporarily interrupt the second operative connection at a second point in time within the operating cycle that is different from the first point in time.

A fully variable actuation both of the inlet valve and of the outlet valve can thereby be provided with only one interrupting element, and therefore the construction space of the valve train is limited despite full variability—both on the inlet side and on the outlet side—to the construction space which, for example, a valve train which is only variable on the inlet side would take up.

A valve train is understood here as meaning in particular a mechanism or a mimic which is configured to actuate charge exchange valves which are assigned to a combustion chamber of an internal combustion engine, in particular to an inlet valve and an outlet valve. The valve train can have mechanical, hydraulic, electrical, electronic and/or other types of elements which serve to actuate the charge exchange valves.

An operative connection between a valve-actuating device and a valve, here in particular the inlet valve and the outlet valve, is understood as meaning in particular a connection or coupling between the valve-actuating device and the corresponding valve, said connection or coupling making it possible for the valve to be actuated, thus in particular opened and/or closed, by the valve-actuating device. The operative connection here can be basically of a mechanical, hydraulic, pneumatic, electrical, electronic or some other type.

A valve-actuating device is understood as meaning in particular a device which is configured to bring about an actuation of a valve, in particular the opening or closing thereof, in particular in order to specify timings for an opening point of time, for a closing point of time and preferably also a valve stroke for the valve. The valve-actuating device can in particular have at least one camshaft with at least one cam, a plurality of camshafts and/or a plurality of cams, or other types of means for actuating valves. The valve-actuating device acts in particular on a first operative end of an operative connection which acts with a second operative end on the valve, here on the inlet valve or the outlet valve. It is possible for the first operative connection and the second operative connection to be assigned a same valve-actuating device. However, it is also possible for the first operative connection to be assigned a first valve-actuating device, wherein the second operative connection is assigned a second valve-actuating device which is different from the first valve-actuating device.

It is possible in particular for the first operative connection to be between a first actuating element and the inlet valve, wherein the second operative connection is between a second actuating element and the outlet valve. However, it is also possible for the first operative connection to be between an actuating element and the inlet valve, wherein the second operative connection is between the same actuating element and the outlet valve.

If the first operative connection is assigned a first actuating element, with the second operative connection being assigned a second actuating element which is different from the first actuating element, the actuating elements can be in particular first and second cams of a same camshaft or of different camshafts, but also first and second elevations on a same cam of a camshaft.

An interrupting element is understood as meaning in particular an element which is configured to temporarily interrupt an operative connection between a valve-actuating device and a valve, in particular in which the operative connection is canceled, for example by mechanical separation, shutting off of hydraulic or pneumatic pressure, disconnection of an electrical connection, electronic inactivation of the operative connection, or the like.

It is important that, on account of the fact that the actuation of the inlet valve of the combustion chamber is separated in time from the actuation of the outlet valve of same combustion chamber, a single interrupting element suffices to alternately interrupt the two operative connections at different times.

According to a development of the invention, it is provided that the first operative connection and the second operative connection are in the form of hydraulic operative connections, wherein the interrupting element is in the form of a switching valve. This constitutes a similarly simple and reliable configuration of the valve train, wherein hydraulic medium can be shut off in a simple manner via the interrupting element in the form of a switching valve in order to interrupt the operative connections. In a particularly preferred refinement, the interrupting element is in the form of a 2/2-way valve. This constitutes a similarly simple and cost-effective and functionally reliable design of the interrupting element. It is possible for the switching valve to have precisely two discrete switching states. However, it is also possible for the switching valve to be switchable between two extreme switching positions into a number of discrete intermediate stages or into a multiplicity of continuous intermediate stages.

According to a development of the invention, it is provided that the first operative connection has a first hydraulic path to a first slave cylinder, wherein the second operative connection has a second hydraulic path to a second slave cylinder, wherein the interrupting element is connected to the first hydraulic path and to the second hydraulic path. This means in particular that hydraulic medium both from the first hydraulic path and from the second hydraulic path can be shut off at different times via the interrupting element. For this purpose, the interrupting element can be brought into fluidic connection in particular with the first hydraulic path and also with the second hydraulic path at different times, in particular via interrupting nonreturn valves which are configured to open up the fluidic connections at times and to block same at times.

A slave cylinder is understood as meaning in particular a hydraulic cylinder which is configured to receive hydraulic medium from a master cylinder, wherein the slave cylinder is connected to a valve, here to the inlet valve or to the outlet valve, in such a manner that the valve is actuated, in particular opened, when the slave cylinder receives hydraulic medium from the master cylinder.

The first hydraulic path is preferably formed between a first master cylinder and the first slave cylinder. The second hydraulic path is preferably formed between a second master cylinder and the second slave cylinder. In this case, the inlet valve and the outlet valve are assigned different master cylinders.

According to a development of the invention, it is provided that the interrupting element is connected both to the first hydraulic path and to the second hydraulic path via a same fluid connection. This means in particular that said interrupting element can be brought into fluidic connection temporarily with the first hydraulic path and temporarily—at other times—with the second hydraulic path via the same fluid connection. For example, a 2/2-way valve as the interrupting element has two fluid connections, wherein said 2/2-way valve is preferably connected with a first fluid connection to the first hydraulic path and to the second hydraulic path, wherein said 2/2-way valve can be fluidically connected by the second fluid connection to a hydraulic medium accumulator in which hydraulic medium shut off from the hydraulic paths can be temporarily stored. It is important that the interrupting means preferably has only one fluid connection for the two hydraulic paths, and not, for example, a separate fluid connection for each hydraulic path, although this is basically also conceivable.

According to a development of the invention, it is provided that the interrupting element is connected to the first hydraulic path via a first interrupting nonreturn valve, wherein the interrupting element Is connected to the second hydraulic path via a second interrupting nonreturn valve. The interrupting nonreturn valves are preferably arranged fluidically parallel to each other. In particular downstream of the common fluid connection of the interrupting element for the two hydraulic paths, a branching is produced here to the first interrupting nonreturn valve, on the one hand, and to the second interrupting nonreturn valve, on the other hand. The interrupting nonreturn valves are preferably pretensioned into a closing position in a direction pointing away from the interrupting element. This has the result that hydraulic medium, when shut off from a hydraulic path via the interrupting nonreturn valve assigned to the hydraulic path, can flow to the interrupting element, but with the other interrupting nonreturn valve to the other hydraulic path remaining blocked, and therefore there is no communication between the hydraulic paths. The interrupting nonreturn valves are therefore provided in particular in order to separate the hydraulic paths from each other, and therefore, despite the common interrupting element, unambiguous valve-opening behavior is ensured both for the inlet valve and for the outlet valve.

According to a development of the invention, it is provided that the interrupting element is fluidically connected to a hydraulic medium accumulator. In particular, the interrupting element is fluidically connected with its second fluid connection, which is different from the first fluid connection connected to the hydraulic paths, to the hydraulic medium accumulator. The interrupting element is configured in particular in order alternately to bring the first hydraulic path and the second hydraulic path, and also temporarily neither of the hydraulic paths, into fluidic connection with the hydraulic medium accumulator. The interrupting element is configured here in particular in order, in a first switching position, to fluidically connect its first fluid connection to its second fluid connection, and, in a second switching position, to block the fluidic connection between its first fluid connection and its second fluid connection. Whether, in the first switching position, the first hydraulic path or the second hydraulic path is then connected to the hydraulic medium accumulator is preferably not decided by the switching position of the interrupting element, but rather this depends on the current pressure ratios in the hydraulic paths. If, during a first period of time during a working cycle of the combustion chamber, hydraulic pressure is built up in the first hydraulic path in order to actuate the Inlet valve, the interrupting element can be shifted into its first switching position in order to shut off hydraulic medium from the first hydraulic path and thus to bring about a variable actuation of the inlet valve. In this case, the second interrupting nonreturn valve prevents hydraulic medium from being able to flow into the second hydraulic path and undesirably there being able to bring about actuation of the outlet valve. During a second period of time, which is different from the first period of time, in the working cycle, a hydraulic pressure is built up in the second hydraulic path in order to actuate the outlet valve. In this period of time, the interrupting element can be switched into its first switching position in order to shut off hydraulic medium from the second hydraulic path and thus to bring about a variable actuation of the outlet valve. In this case, the first interrupting nonreturn valve prevents hydraulic medium from being able to flow Into the first hydraulic path and bring about an undesirable actuation of the inlet valve there. At other times than in the first period of time and in the second period of time, and also in the first or second period of time whenever a variable actuation of a valve Is not desired, the interrupting element is preferably arranged in its second switching position.

The object is also achieved by an internal combustion engine being provided which has a valve train according to one of the previously described exemplary embodiments. In particular the advantages which have already been explained in conjunction with the valve train are realized in conjunction with the internal combustion engine.

The internal combustion engine preferably has a plurality of combustion chambers, wherein each combustion chamber is in each case assigned at least one inlet valve and at least one outlet valve. It is possible for each combustion chamber to be assigned more than one inlet valve and/or more than one outlet valve, wherein in particular two inlet valves and two outlet valves can be provided per combustion chamber. The inlet valves and the outlet valves of each combustion chamber are assigned to each other in pairs, wherein each valve pair consisting of an inlet valve and an outlet valve of the same combustion chamber is assigned an interrupting element. Each valve pair is preferably assigned precisely one and only one interrupting element. If a combustion chamber has more than one inlet valve and/or more than one outlet valve, a plurality of inlet valves and/or outlet valves of a same combustion chamber can be assigned to one another and can be operatively connected to precisely one and only one interrupting element. In particular, it is possible for a combustion chamber to have precisely two inlet valves and precisely two outlet valves, wherein the two inlet valves and the two outlet valves are assigned to one another, and therefore precisely one interrupting element is provided for all four valves. The internal combustion engine has a control unit, wherein the control unit has an actuating means for each interrupting element assigned to a valve pair. The control unit for each interrupting element preferably has precisely one actuating means. Such an actuating means is preferably in particular in the form of an electronic amplifying means, in particular in the form of a power amplifier. It has been shown that advantageously in the case of the valve train proposed here, in particular half of the actuating means, in particular power amplifiers, otherwise provided for a fully variable actuation both of the inlet valves and of the outlet valves can be saved because the valve pairs consisting of inlet and outlet valves are in each case variably actuated by only one interrupting element, and therefore only one actuating means, thus only one power amplifier, has to be provided in each case per valve pair. The saving which can be realized in such a manner, in particular halving of actuating means, in particular power amplifiers, means a reduction in costs and energy savings during operation.

According to a development of the invention, it is provided that the internal combustion engine has a control unit, in particular the previously explained control unit, which is configured to actuate the at least one interrupting element at least twice per operating cycle of the combustion chamber assigned to the interrupting element. By this means, a variable actuation both of the inlet valve and of the outlet valve can be realized in the same operating cycle. The control unit is preferably configured in order to actuate each interrupting element assigned to a combustion chamber at least twice per operating cycle of the respective combustion chamber.

The internal combustion engine is preferably in the form of a reciprocating piston engine. It is possible for the internal combustion engine to be configured for driving a passenger motor vehicle, a truck or a utility vehicle. In a preferred exemplary embodiment, the internal combustion engine serves for driving in particular heavy land vehicles or watercraft, for example mine vehicles, trains, in which the internal combustion engine is used in a locomotive or a railcar, or ships. The internal combustion engine can also be used for driving a vehicle serving for defense purposes, for example a tank. An exemplary embodiment of the internal combustion engine is preferably also used in a stationary manner, for example for the stationary energy supply during operation with an emergency power supply, during continuous load operation or peak load operation, wherein the internal combustion engine in this case preferably drives a generator. Stationary use of the internal combustion engine for driving auxiliary units, for example fire extinguishing pumps on oil rigs, is also possible. Furthermore, the internal combustion engine can be used in the sphere of extracting fossil resources and in particular fuels, for example oil and/or gas. Use of the internal combustion engine in the industrial sphere or in the construction sphere, for example in a construction machine, for example in a crane or an excavator, is also possible. The internal combustion engine is preferably in the form of a diesel engine, a gasoline engine, a gas engine for operation with natural gas, biogas, special gas or another suitable gas. In particular if the internal combustion engine is in the form of a gas engine, it is suitable for use in a cogeneration plant for stationary generation of energy.

BRIEF DESCRIPTION OF THE DRAWING

The invention is explained in more detail below with reference to the drawing, which.

DETAILED DESCRIPTION OF THE INVENTION

Figure 1:
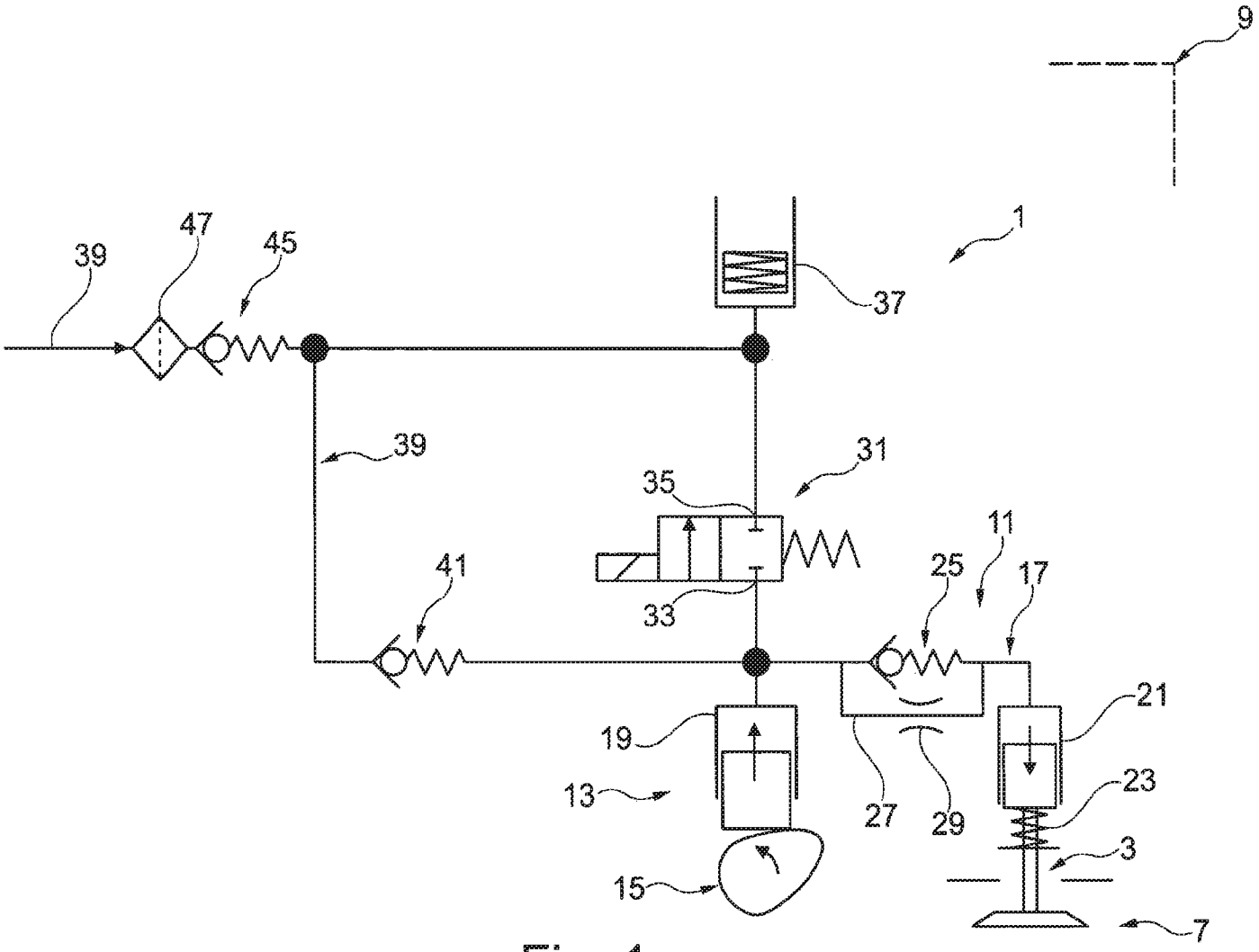
FIG. 1 shows a schematic illustration of an example of a variable valve train for an inlet valve.

FIG. 1 shows a schematic illustration of an example of a valve train 1 for the variable actuation of an inlet valve 3.

The inlet valve 3 is assigned to a combustion chamber 7 (only indicated schematically here) of an internal combustion engine 9 (likewise only indicated schematically).

The valve train 1 has a first operative connection 11 between a valve-actuating device 13, here specifically between a first actuating element 15, which is in the form of a cam of a camshaft, and the inlet valve 3. Said first operative connection 11 is in the form of a hydraulic operative connection and to this extent comprises a first hydraulic path 17. The first hydraulic path 17 has a first master cylinder 19, which interacts with the first actuating element 15, and a first slave cylinder 21, wherein, during a rotational movement of the first actuating element 15, the first master cylinder 19 is caused to perform a stroke movement, by means of which hydraulic medium is forced out of the first master cylinder 19 via the first hydraulic path 17 into the first slave cylinder 21, wherein the first slave cylinder 21 is operatively connected to the inlet valve 3 in such a manner that the latter is forced by the first slave cylinder 21 counter to the prestressing force of a prestressing element 23, in particular a spring, into an open position.

In the first hydraulic path 17, a first nonreturn valve 25 and a first bypass 27, which bypasses the first nonreturn valve 25 and in which a first throttle element 29 is arranged, are arranged between the first master cylinder 19 and the first slave cylinder 21.

If hydraulic medium is forced out of the first master cylinder 19, the first nonreturn valve 25 can open, and therefore hydraulic medium can flow via the first nonreturn valve 25 to the slave cylinder 21. If the first actuating element 15 rotates further, a volume in the first master cylinder 19 is increased again, and therefore hydraulic medium can flow back into the latter. At the same time, the hydraulic medium in the first slave cylinder 21 is pressurized by the prestressing element 23. In this operating state, the first nonreturn valve 25 is forced into its blocking position. The hydraulic medium then flows out of the first slave cylinder 21 via the first bypass 27 and the first throttle element 29 back into the first master cylinder 19, with the inlet valve 3 being shifted at the same time to its closed position. The closing behavior of the inlet valve 3 is determined in particular by the first prestressing element 23, on the one hand, and the first throttle element 29, on the other hand, in particular by the coordination thereof with each other.

In order to bring about variable actuation of the inlet valve 3, the valve train 1 has a first interrupting element 31 which is assigned to the first operative connection 11 and is configured to interrupt the first operative connection 11 at times. The first interrupting element 31 is preferably in the form of a switching valve, here in particular in the form of a 2/2-way valve.

The first interrupting element 31 is connected here by a first fluid connection 33—on the side of the first master cylinder 19—to the first hydraulic path 17. The first interrupting element 31 is fluidically connected by a second fluid connection 35 to a hydraulic medium accumulator 37. The first interrupting element 31 is configured in order. In a first switching state, to produce a fluidic connection between the first fluid connection 33 and the second fluid connection 35 and therefore at the same time between the first hydraulic path 17 and the hydraulic medium accumulator 37, and in order, in a second switching state (illustrated here), to interrupt the fluidic connection between the first fluid connection 33 and the second fluid connection 35.

A variable actuation of the inlet valve 3 is now brought about by the first interrupting element 31 in accordance with the lost-motion principle by the latter being shifted into its first switching state, for example at a predetermined point in time during a stroke movement of the first valve 3 as a result of which the fluidic connection between the first hydraulic path 17 and the hydraulic medium accumulator 37 is opened up, h e hydraulic medium forced out of the first master cylinder 19 is then at least partially shut off via the first interrupting element 31 into the hydraulic medium accumulator 37, as a result of which the pressure in the first hydraulic path 17 on the side of the first master cylinder 19 drops, and therefore blocks the first nonreturn valve 25. The valve stroke of the inlet valve 3 is thereby interrupted, and the latter closes, with hydraulic medium being likewise forced out of the first slave cylinder 21 by the prestressing force of the prestressing element 23 via the first bypass 27 and the first throttle element 29 and further via the first interrupting element 31 into the hydraulic medium accumulator 37. A delayed valve stroke of the inlet valve 3 can also be brought about in an analogous manner by, at the beginning of the stroke movement of the first master cylinder 19, the first interrupting element 31 being shifted into its first switching state and only subsequently being shifted into its second switching state during the stroke movement of the first master cylinder 19. It is therefore possible to provide a fully variable valve train for the inlet valve 3 by means of the first interrupting element 31. If, by contrast, the first interrupting element 31 remains in its second switching state during an operating cycle of the internal combustion engine 9, a normal valve stroke of the inlet valve 3 is brought about, the stroke curve of which is substantially determined by the configuration, in particular shape, of the first actuating element 15. In particular whenever the first interrupting element 31 is in the form of a continuous switching valve which can take up a multiplicity of intermediate positions between the first switching state and the second switching state, a valve stroke curve virtually as desired can be produced in a very flexible manner below the normal valve stroke curve determined by the first actuating element 15.

In a period of time in which the volume of the first master cylinder 19 is increased again, hydraulic medium is conducted out of the hydraulic medium accumulator 37 via a bypass path 39 and a first bypass nonreturn valve 41 back Into the first master cylinder 19.

In particular for an Initial supply of the first hydraulic path 17 with hydraulic medium, but also for leakage compensation, the bypass path 39 is connected here to a hydraulic medium source 43 via a source nonreturn valve 45. It is possible here for a filter 47 to be provided in this connection, in particular upstream of the source nonreturn valve 45.

Figure 2:
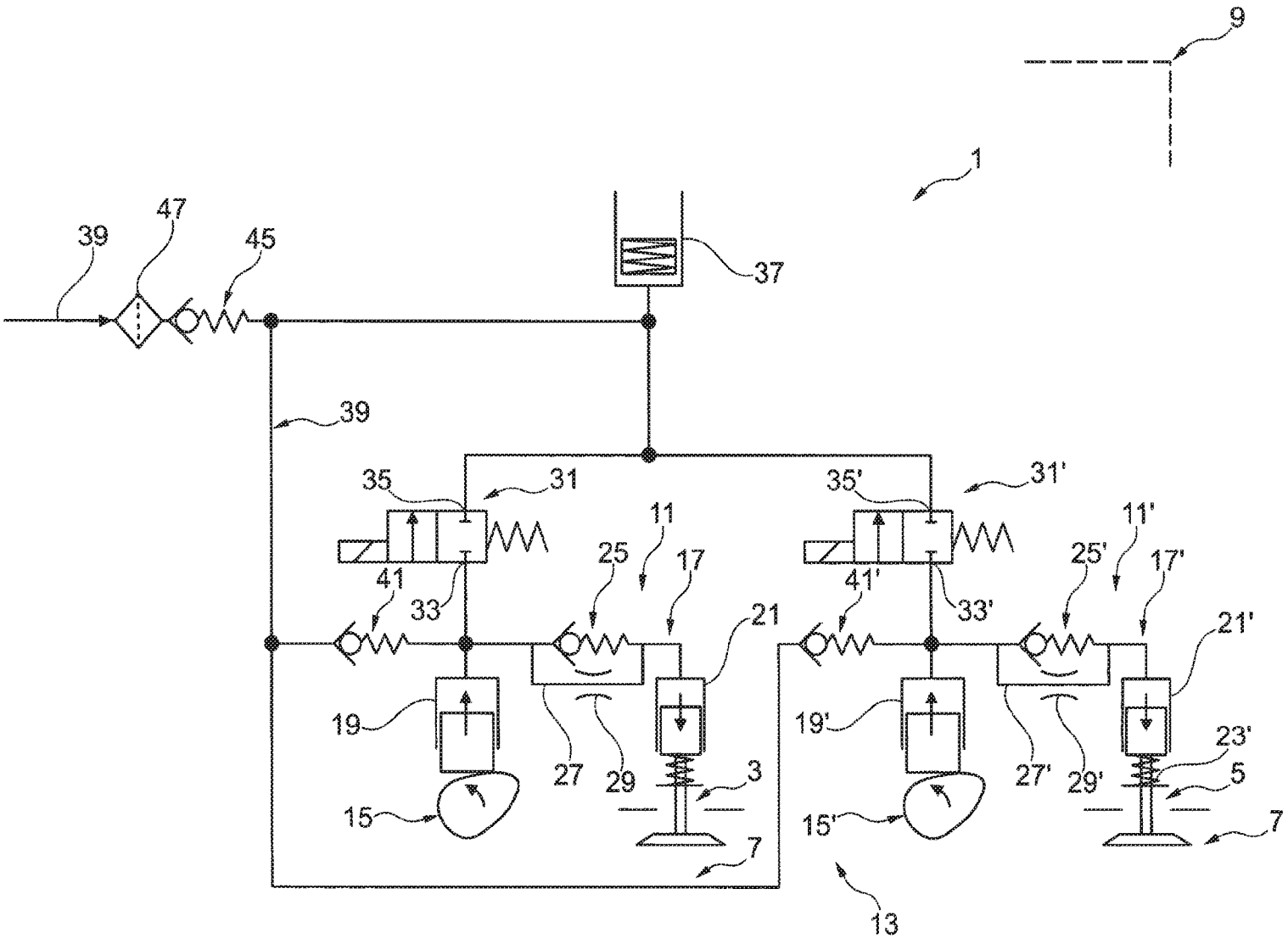
FIG. 2 shows a schematic illustration of an example of a valve train for variable actuation of an inlet valve and an outlet valve.

FIG. 2 shows a schematic illustration of a second example of a valve train 1 for the variable actuation of an inlet valve 3 and of an outlet valve 5. Identical and functionally identical elements are provided with the same reference signs, and therefore reference is made in this respect to the previous description. The inlet valve 3 and the outlet valve 5 are in particular preferably assigned to the same combustion chamber 7 of the internal combustion engine 9.

The outlet valve 5 here is assigned a second operative connection 11' between the valve-actuating device 13, here specifically a second actuating element 15', which is likewise in the form of a cam, wherein the second operative connection 11' is in the form of a hydraulic operative connection and has a second hydraulic path 17'. The latter connects a second master cylinder 19' to a second slave cylinder 21', wherein the second actuating element 15' acts on the second master cylinder 19'. The outlet valve 5 has a second prestressing element 23'. A second nonreturn valve 25' which is bypassed by a second bypass 27' by the arrangement of a second throttle element 29' is arranged in the second hydraulic path 17'.

The second hydraulic path 17' is fluidically connected—on the side of the second master cylinder 19'—to a second first inlet 33' of a second interrupting element 31', wherein the second interrupting element 31' has a second second fluid connection 35'. The first interrupting element 31 and the second interrupting element 31' are fluidically connected via their second fluid connections 35, 35' to the same hydraulic medium accumulator 37.

The second interrupting element 31' here is also in the form of a switching valve, in particular a 2/2-way valve.

The operating principle of the actuation of the outlet valve 5 and of the second hydraulic path 17' and of the second interrupting element 31' is identical to the operating principle explained previously in conjunction with FIG. 1 with regard to the inlet valve 3. Reference is therefore made to this extent to the previous description. Hydraulic medium is also returned from the hydraulic medium accumulator 37 into the second hydraulic path 17' here via the bypass path 39 and via a second bypass nonreturn valve 41'.

It is important that an interrupting element is provided in each case here for the inlet valve 3, on the one hand, and the outlet valve 5, on the other hand, namely the first interrupting element 31 and the second interrupting element 31'. This necessitates a comparatively expensive and construction-space-demanding configuration of the valve train 1.

Figure 3:
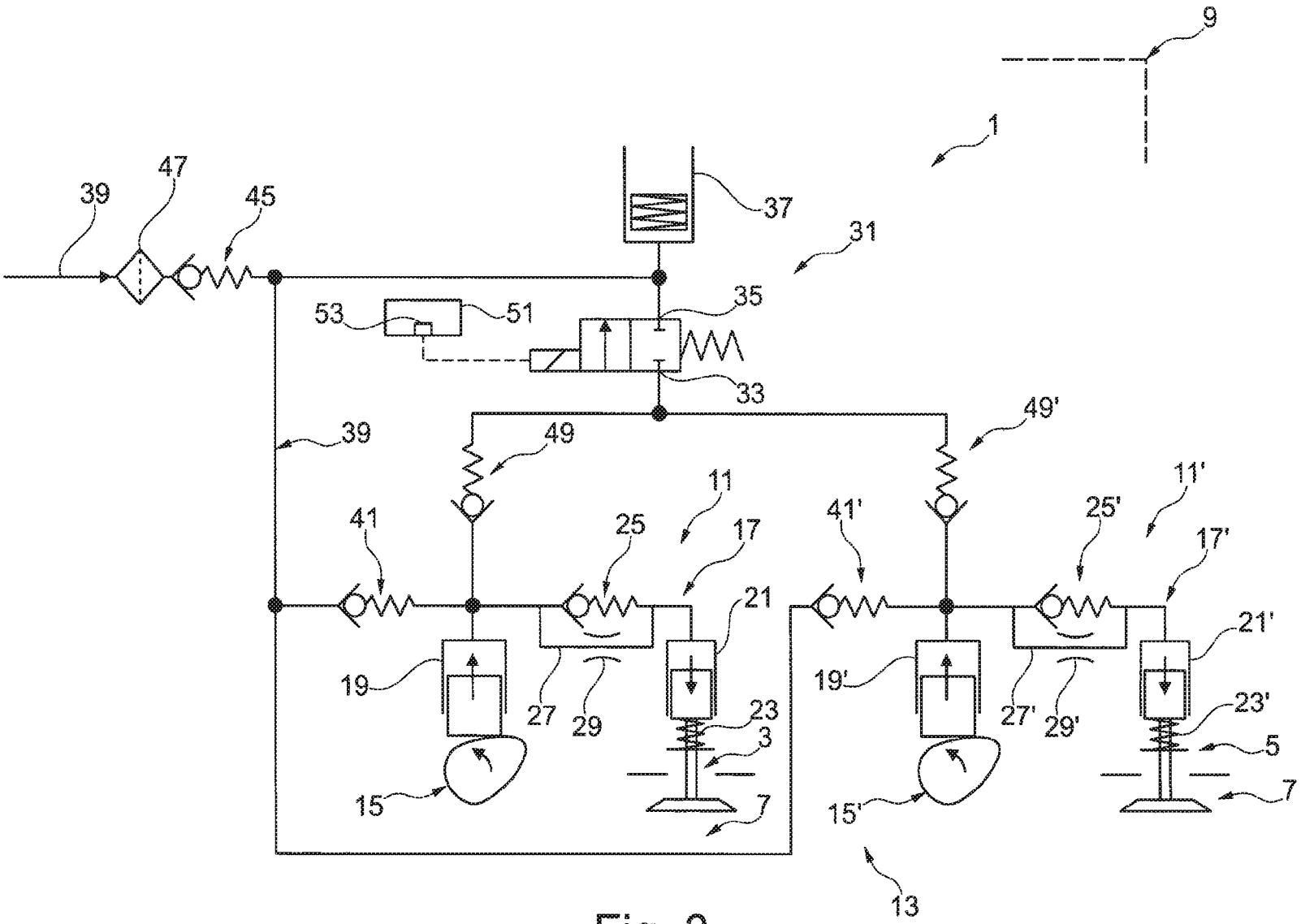
FIG. 3 shows a schematic illustration of an exemplary embodiment of an internal combustion engine with a valve train for variable actuation of an inlet valve and an outlet valve.

FIG. 3 shows a schematic Illustration of an exemplary embodiment of the valve train 1. Identical and functionally identical elements are provided with the same reference signs, and therefore reference is made to this extent to the previous description. The first operative connection 11 and the second operative connection 11'—apart from the variable actuation of the inlet valve 3 and the outlet valve 5—function here precisely as has been described with respect to FIGS. 1 and 2.

However, it has been recognized that it is possible to achieve full variability of the actuation for both valves, namely the inlet valve 3 and the outlet valve 5, by only one and precisely one interrupting element 31 being used jointly for the two valves, namely the inlet valve 3 and the outlet valve 5. In the exemplary embodiment illustrated here, only one interrupting element 31 is therefore provided which is assigned both to the first operative connection 11 and to the second operative connection 11'. Said interrupting element is configured for temporarily interrupting both the first operative connection 11 and the second operative connection 11'. This is possible because there is a gap in time between the actuation times of the inlet valve 3, on the one hand, and the outlet valve 5, on the other hand, and therefore precisely one interrupting element 31 can be actuated at a first time for the variable actuation of the inlet valve 3, wherein said interrupting element can be actuated at a second time, which is different from the first time, for the variable actuation of the outlet valve 5. The first time and the second time typically do not overlap during the operation of the internal combustion engine 9, and therefore the full variability for both valves can be ensured with the one interrupting element 31.

The one interrupting element 31 is connected here via its first fluid connection 33 both to the first hydraulic path 17 and to the second hydraulic path IT.

In particular, it is shown with reference to FIG. 3 that the first fluid connection 33 is connected to the first hydraulic path 17 via a first interrupting nonreturn valve 49, wherein the first fluid connection 33 is connected via a second interrupting nonreturn valve 49' to the second hydraulic path 17'. The interrupting nonreturn valves 49, 49' are arranged here fluidically parallel to each other; in particular, a branching is produced from the first fluid connection 33 to the first and second interrupting nonreturn valves 49, 49'. The interrupting nonreturn valves 49, 49' are in each case prestressed in a direction pointing away from the first fluid connection 33 and toward the hydraulic paths 17, 17' into a closed position. Since hydraulic medium pressure is built up with a time delay in the first and second hydraulic paths 17, 17', the operating principle is produced by the fact that, for example, during the build-up of pressure in the first hydraulic medium path 17 by the first master cylinder 19 and simultaneous opening of the first interrupting element 31, i.e. the switching thereof into the first switching state, the first interrupting nonreturn valve 49 can open, and therefore hydraulic medium can be shut off out of the first hydraulic path 17 via the first interrupting nonreturn valve 49 and the interrupting element 31 into the hydraulic medium accumulator 37. At the same time, however, the second interrupting nonreturn valve 49' is closed, and therefore there is no communication between the hydraulic paths 17, 17'. The same applies precisely conversely for a period of time in which hydraulic medium pressure is built up in the second hydraulic path IT by the second master cylinder 19' and the switch-over element 31 is switched into its first open switching state. Overall, the interrupting nonreturn valves. 49, 49' therefore prevent an undesirable hydraulic communication between the two hydraulic paths 17, 17' in a simple and efficient manner.

The interrupting element 31 is configured overall in order optionally, namely in particular depending on its switching position, on the one hand, and the pressure levels in the hydraulic medium paths 17, 17', on the other hand, to bring the first hydraulic path 17, the second hydraulic path 17', or—in its second switching state—neither of the hydraulic paths 17, 17' into fluidic connection with the hydraulic medium accumulator 37.

The internal combustion engine 9 preferably has a plurality of combustion chambers 7, wherein in particular each of the combustion chambers 7 is in each case assigned an inlet valve 3 and an outlet valve 5. In particular, each of the combustion chambers 7 can also be assigned two inlet valves 3 and two outlet valves 5. The inlet valves 3 and the outlet valves 5 of the individual combustion chambers 7 are assigned to one another in pairs, wherein each valve pair—as illustrated in FIG. 3—is assigned precisely one interrupting element 31. In addition, the internal combustion engine 9 has a control unit 51 which has an actuating means 53, in particular a power amplifier, for each interrupting element 31 assigned to a valve pair. In the case of the exemplary embodiment according to FIG. 3, in particular in contrast to the configuration according to FIG. 2, only half the number of actuating means 53 are required for the internal combustion engine 9 because each valve pair is assigned only one interrupting element 31 instead of two interrupting elements 31, 31'.

The control unit 51 is configured in particular in order to actuate the interrupting elements 31, which are assigned thereto, at least twice per operating cycle of a combustion chamber 7 assigned to the respective interrupting element 31, namely once for the variable actuation of the inlet valve 3, and a second time for the variable actuation of the outlet valve 5.

The fact that the control unit 51 is configured for this purpose does not, of course, exclude the fact that also at least one of the valves 3, 5 is not variably actuated once during an operating cycle, wherein then the interrupting element 31 is also not actuated. It is also possible for the interrupting element 31 not to be actuated at all in an operating cycle because none of the valves 3, 5 is actuated variably.

Overall, it has been shown that, with the valve train 1 proposed here, in particular in a same construction space volume as in the case of a fully variable valve train only on the inlet side, use can be made of a valve train which is second interrupting element 31' per valve pair being omitted. This also results in a cost reduction on account of a lower number of components. Furthermore, the required power amplifiers in the control unit 51 are reduced, and therefore costs and energy expenditure are also omitted in this respect.

The invention claimed is:

1. An internal combustion engine, comprising:

a plurality of combustion chambers;

an inlet valve and an outlet valve assigned to each of the combustion chambers, the inlet valve and the outlet valve of each combustion chamber being assigned to each other as a valve pair;

a valve train comprising a valve actuating device, a first operative connection between the valve actuating device and the inlet valve of each valve pair, and a second operative connection between the valve actuating device and the outlet valve of each valve pair;

an interrupting element assigned to each valve pair by being connected to the first operative connection and the second operative connection, the interrupting element being configured to temporarily interrupt the first and second operative connections; and a control unit, including a respective actuation means for each interrupting element assigned to a valve pair, wherein the control unit is configured to actuate each interrupting element at least twice per working cycle of a corresponding combustion chamber of the plurality of combustion chambers.

2. The internal combustion engine according to claim 1, wherein the first and second operative connections are hydraulic operative connections, wherein the interrupting element is a switching valve.

3. The internal combustion engine according to claim 1, wherein the first operative connection includes a first hydraulic path to a first slave cylinder, wherein the second operative connection includes a second hydraulic path to a second slave cylinder, wherein the interrupting element is connected to the first hydraulic path and to the second hydraulic path.

4. The internal combustion engine according to claim 3, wherein the interrupting element is connected to the first hydraulic path and to the second hydraulic path by a common fluid connection.

5. The internal combustion engine according to claim 3, wherein the interrupting element is connected to the first hydraulic path by a first interrupting nonreturn valve, and the interrupting element is connected to the second hydraulic path by a second interrupting nonreturn valve.

6. The internal combustion engine according to claim 3, further comprising a hydraulic medium accumulator fluidically connected to the interrupting element, wherein the interrupting element is configured to selectively and independently bring the first hydraulic path and the second hydraulic path into fluidic connection with the hydraulic accumulator.

* * * * *